United States Patent [19]

Masser

[11] 4,235,079

[45] Nov. 25, 1980

[54] VAPOR COMPRESSION REFRIGERATION AND HEAT PUMP APPARATUS

[76] Inventor: Paul S. Masser, 5312 E. Royal Palm Rd., Scottsdale, Ariz. 85253

[21] Appl. No.: 974,301

[22] Filed: Dec. 29, 1978

Related U.S. Application Data

[63] Continuation-in-part of Ser. No. 868,540, Jan. 11, 1978, abandoned.

[51] Int. Cl.[3] ..... F25B 9/00; F25B 1/00; F25D 9/00

[52] U.S. Cl. ..... 62/87; 62/116; 62/402

[58] Field of Search ..... 62/116, 402, 87

[56] References Cited

U.S. PATENT DOCUMENTS

| | | | |
|---|---|---|---|
| 2,519,010 | 8/1950 | Zearfoss, Jr. | 62/116 |
| 3,277,658 | 10/1966 | Leonard, Jr. | 62/116 |
| 3,367,125 | 2/1968 | McGrath | 62/116 |
| 3,400,555 | 9/1968 | Granryd | 62/402 |
| 3,934,424 | 1/1976 | Goldsberry | 62/87 |
| 4,170,116 | 10/1979 | Williams | 62/116 |

*Primary Examiner*—Lloyd L. King
*Attorney, Agent, or Firm*—Warren F. B. Lindsley

[57] ABSTRACT

A vapor compression refrigeration and/or heat pump system employing a particular type of expansion motor replacing the expansion valve of a conventional system.

4 Claims, 8 Drawing Figures

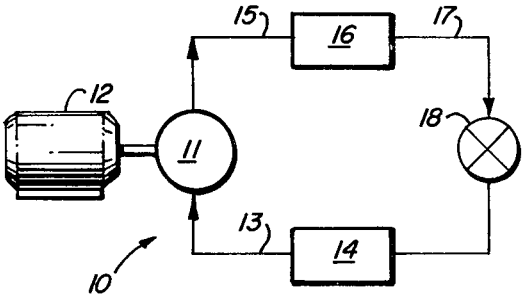
FIG. 1
(PRIOR ART)
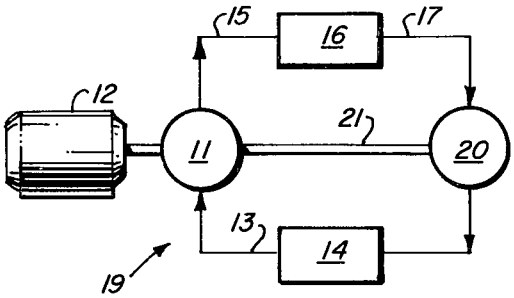
FIG. 2
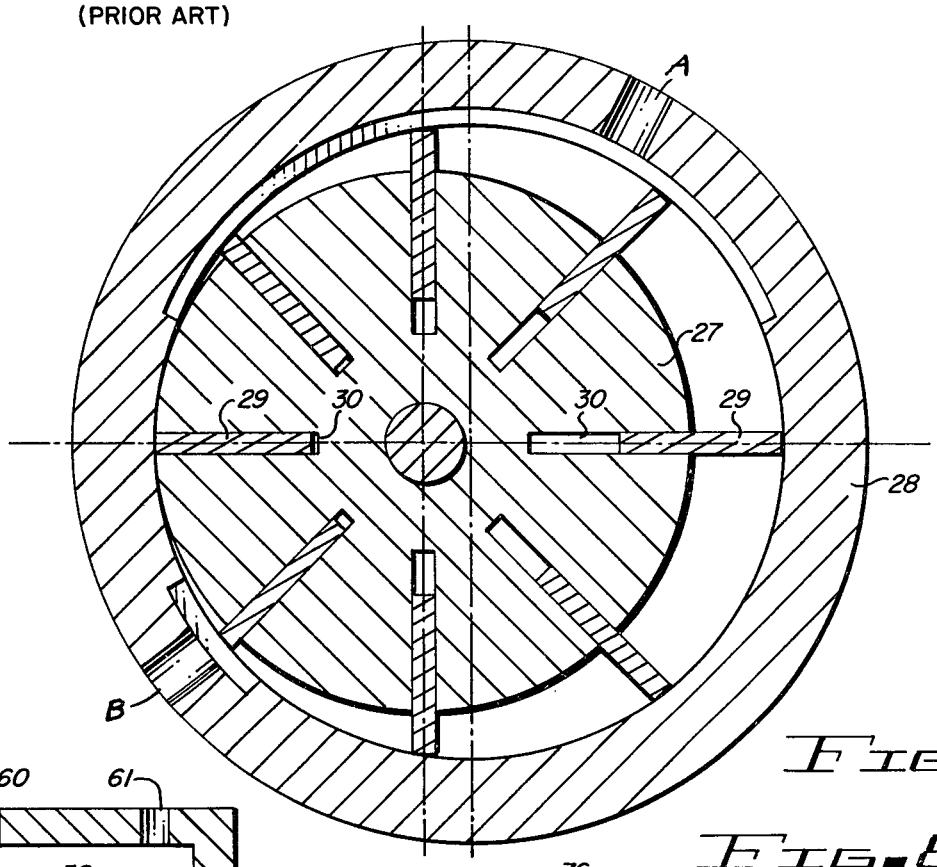
FIG. 3
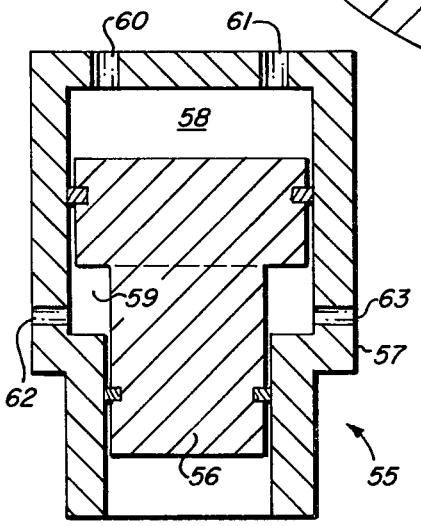
FIG. 6
FIG. 8
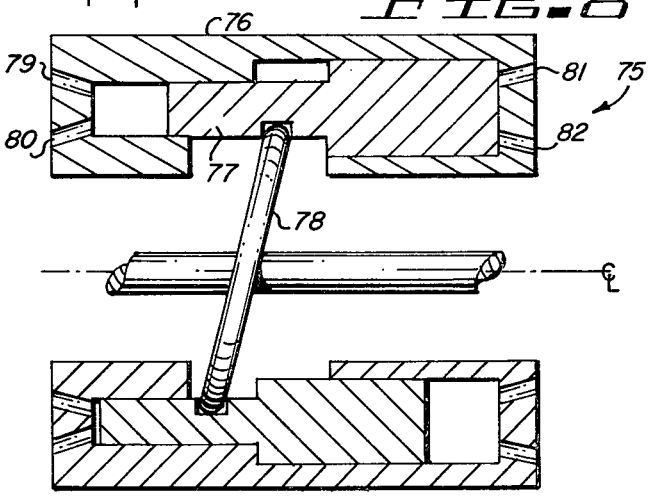

VAPOR COMPRESSION REFRIGERATION AND HEAT PUMP APPARATUS

This is a continuation-in-part of U.S. Patent Application, Ser. No. 868,540, filed Jan. 11, 1978 and entitled IMPROVED VAPOR COMPRESSION REFRIGERATION AND HEAT PUMP CYCLE now abandoned.

BACKGROUND OF THE INVENTION

This invention relates to refrigeration and/or heat pump cycles and more particularly to apparatus for carrying out these cycles.

In theoretical vapor compression refrigeration, saturated vapor refrigerants at low pressure enter a compressor and undergo isentropic compression. The high pressure vapor enters a condenser and heat is rejected from the fluid at constant pressure. The working fluid leaves the condenser as a saturated liquid. An isenthalpic throttling process follows across an expansion valve or capillary tube. The working fluid is then evaporated at constant pressure with the working fluid absorbing heat to complete the cycle.

Direct expansion refrigeration units have not generally taken advantage of the energy or available work lost in the execution of the cycle through the throttling or free expansion of the liquid refrigerant into the evaporator of the refrigeration machine. Generally, only limited use has been made of the conversion into mechanical energy of the kinetic energy possessed by the refrigerant which flows from the high pressure side to the low pressure side of the refrigeration system.

It is known for refrigerant to be expanded in a turbine motor prior to passing into an evaporator, and the turbine motor is used to drive a centrifical refrigerant compressor or perform other work in the system. While such expedients may provide advantages in a refrigeration system, they can not utilize all the energy which would otherwise be a loss in the system, for performing useful work to increase the efficiency of the system.

Several advantages are obtained by the use of positive displacement expansion motors as disclosed herein compared to the prior art. These positive displacement closed expansion motors have a theoretical efficiency of 100 percent compared to about 65 percent for the type of turbine required for the usual refrigeration system.

The closed expansion motor also reduced losses caused by the absence of thermodynamic equilibrium in the more rapid open expansion of a turbine. Further, the basic process of open expansion of a high pressure liquid to produce kinetic energy of the fluid and then conversion of this kinetic energy into mechanical energy in a turbine has inherent losses not encountered in closed expansion inside the expanding chamber of a direct expansion motor. This is specially true for the subject system where two phase flow is involved. Also, the turbine must have a tip speed of the same magnitude as the velocity of the expanded gas (open expansion through nozzle) to operate efficiently. This requires rotation at a high rate or speed which is not compatable with direct coupling to the main refrigeration compressor or a blower, etc., as disclosed here.

DESCRIPTION OF THE PRIOR ART

U.S. Pat. No. 3,277,658 discloses a refrigeration system and method of improving its efficiency by utilizing refrigerant flash gas. A small turbocompressor is driven by the refrigerant flash gas which is discharged from the turbine into an evaporator. The turbocompressor lifts refrigerant from a relatively low pressure side to a relatively high pressure side of the system, i.e., from the evaporator to the refrigerant condenser.

U.S. Pat. No. 3,934,424 discloses a refrigerant system employing an expander compressor unit which utilizes the kinetic energy of an expanded refrigerant to power a turbine which drives a small centrifical compressor to aid the primary compressor of a refrigeration system in compressing gaseous vapors from evaporators pressure to condenser pressure.

SUMMARY OF THE INVENTION

This invention relates to vapor compression refrigeration and/or heat pump systems as commonly used in automobiles, homes and buildings and, more particularly, to apparatus employing a high expansion ratio motor driven by the working fluid which motor replaces the expansion valve in a conventional system.

It is, therefore, one object of this invention to provide a new and improved refrigeration system and apparatus therefor.

Another object of this invention is to provide improved refrigeration equipment which utilizes energy which would otherwise be a loss in the system to perform useful work and thereby increase the efficiency of the system.

A further object of this invention is to replace the usual blower in a conventional refrigeration system with an expansion motor.

Further objects and advantages of this invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawing in which:

FIG. 1 is a schematic diagram of a vapor compression refrigeration cycle illustrating the prior art;

FIG. 2 is a schematic diagram of a vapor compression refrigeration cycle illustrating the invention;

FIG. 3 is a diagrammatical representation of a vane compressor or expander employing a single chamber;

FIG. 6 is a diagrammatic illustration of a combination compressor and expander motor employing one piston with two diameter portions;

FIG. 8 is a diagrammatic illustration of a swash plate driven piston for a compressor, expander combination.

DESCRIPTION OF THE PREFERRED EMBODIMENT

Figure 4:
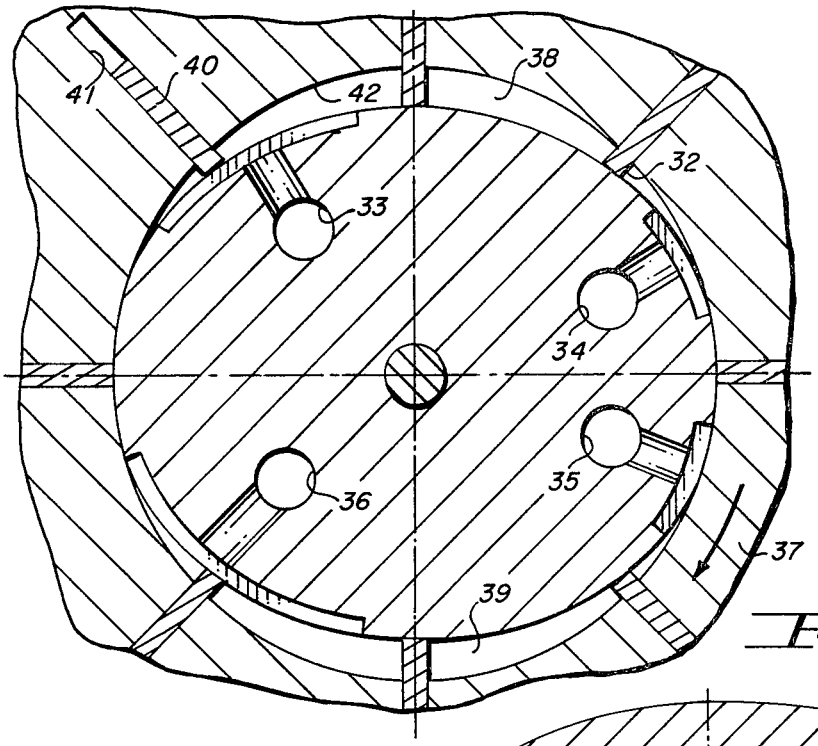
FIG. 4 is a diagrammatic illustration of an inside out vane combination expander and compressor configuration which may be substituted for the compressor and expander shown in FIG. 2.

Referring more particularly to the drawings by characters of reference, FIG. 1 discloses a prior art refrigeration system or apparatus 10 comprising a compressor 11 of any desired type driven by any suitable means such as an electric motor 12 and receives saturated vapor refrigerants at a low pressure through a main suction line 13 from an evaporator 14 and passes compressed refrigerant through a main discharge line 15 to a refrigerant condenser 16. The high pressure vapor enters the condenser 16 where heat is rejected from the fluid at constand pressure. From the condenser 16, the refrigerant flows as a saturated liquid through a condensate line 17 to an expansion valve 18 where an isenthalpic throttling process occurs across the valve. The working fluid is then evaporated in evaporator 14 at constant pressure with the working fluid absorbing heat to complete the cycle.

FIG. 2 discloses a modification of the system and apparatus shown in FIG. 1 wherein like parts are given the same reference characters. This sytem or apparatus 19 differs from the prior art system shown in FIG. 1 by utilizing a high expansion ratio motor 20 in place of the expansion valve 18 shown in FIG. 1. A high expansion ratio motor of approximately 20 to 1 on a volume basis is needed because the working fluid starts the expansion as a liquid with a relatively high density and then boils and expands resulting in a large increase in specific volume. For this same reason, the displacement of motor 20 must also be large, i.e., on the order of forty percent of the compressor's displacement.

This motor saves energy normally unavailable in the expansion valve in the conventional system shown in FIG. 1.

As the working fluid passes through the expansion motor 20, the motor provides a cooling effect on the fluid and through rotation of the motor part generates rotary or reciprocating mechanical power depending on the type of motor utilized.

The power obtained from the expansion motor 20 can be utilized for any useful purpose. In FIG. 2, one suitable use of this power is diagrammatically shown wherein the output shaft of motor 20 is connected to compressor 11 or blowers (not shown) associated therewith through shaft 21 for aiding in the rotation thereof or eliminating the power requirements of associated blowers or fans. In this type of arrangement, about a twenty five percent decrease in the normal energy requirements for operating compressor 11 is experienced. When the system operates as a heat pump, about a twenty percent reduction in energy input requirements is experienced.

A number of different types of expansion motors may be utilized in the system shown in FIG. 2 with FIGS. 3–8 illustrating suitable motor configurations.

FIG. 3 diagrammatically illustrates one of these configurations wherein a rotor 27 is mounted in an off-center arrangement within housing 28. The rotor is provided with a plurality of vanes 29 each mounted in a different slot 30 extending into the periphery of the motor at diametrically opposite points on the surface of the rotor. A pair of ports A and B are shown. The desired expansion (or compression) ratio is obtained by the proper choice of the number of vanes and size of port B. Increasing the number of vanes and decreasing the size (width) of port B increases the expansion (or compression) ratio.

The following chart indicates the functional characteristics of this configuration.

| FUNCTION | PORT A | PORT B | ROTATION |
|---|---|---|---|
| COMPRESSOR | INLET | OUTLET | CLOCKWISE |
| EXPANDER | OUTLET | INLET | COUNTER-CLOCKWISE |

It should be noted that the expansion motor 20 and compressor 11 may be combined into a single unit. FIG. 4 discloses such a unit wherein a fixed rotor 32 is provided with a compression inlet port 33 and a compression outlet port 34 as well as expander inlet port 35 and expander outlet port 36. A housing 37 is arranged to rotate around the off-center rotor so as to provide compression and expansion chambers 38 and 39. A plurality of vanes 40 are spacedly positioned around the periphery of the housing as shown operable in slots 41 in the inside periphery 42 of the housing with only one vane and slot being numbered in the drawing for clarity purposes. It should be noted that the housing can be stationary and the rotor mounted for rotation, but in this instance, rotating journals for the inlet and outlet ports will then be required.

Figure 5:
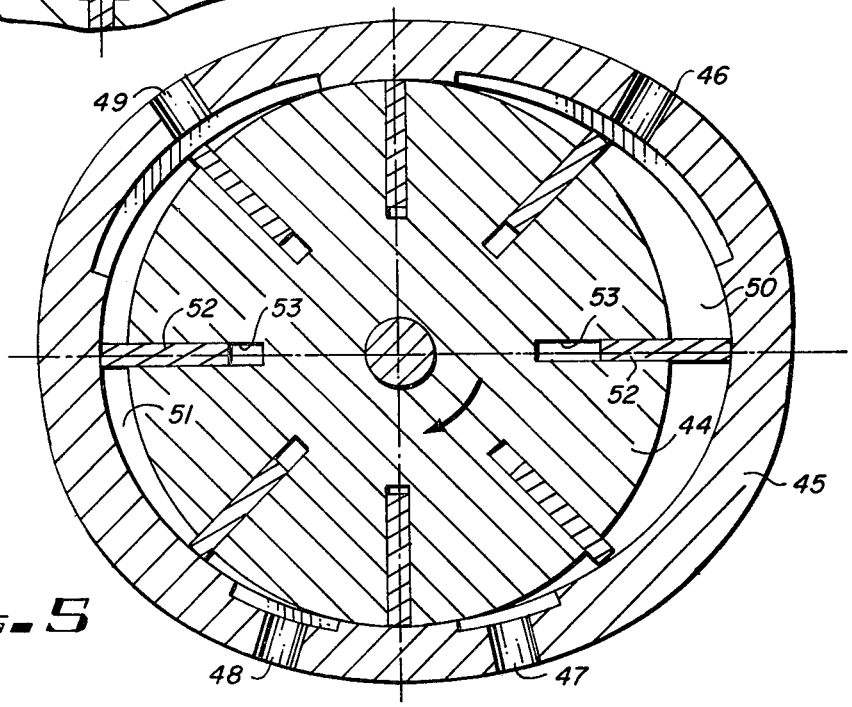
FIG. 5 is a diagrammatic illustration of a two chamber vane compressor and expander showing another embodiment for replacing the expander motor and compressor shown in FIG. 2.

FIG. 5 illustrates a two chamber vane compressor and expander 43 employing a rotating rotor 44 mounted within a housing 45 having compressor inlet and outlet ports 46 and 47 and expander inlet and outlet ports 48 and 49. The oblong opening in housing 45 defines compression and expander chambers 50 and 51, respectively. A plurality of vanes 52, a pair of which are numbered in the drawing are mounted in slots 53 in the rotor at diametrically opposed points, as shown in the drawing.

FIG. 6 discloses a combination compressor and expander apparatus 55 embodying a single piston 56 of two different diameters and defining in housing 57 compression and expansion chambers 58 and 59. Compressor inlet and outlet ports 60, 61 and expander inlet and outlet ports 62, 63 are shown connected to the chambers 58 and 59, respectively.

It should be noted that in the compressor, expander dual functional structures, the inlet and outlet lines of FIG. 2 of the compressor 11 and expander (i.e., expander motor 20) are connected to the respective inlet and outlet ports of the combination compressor, expander structures shown in FIGS. 3–6.

Figure 7:
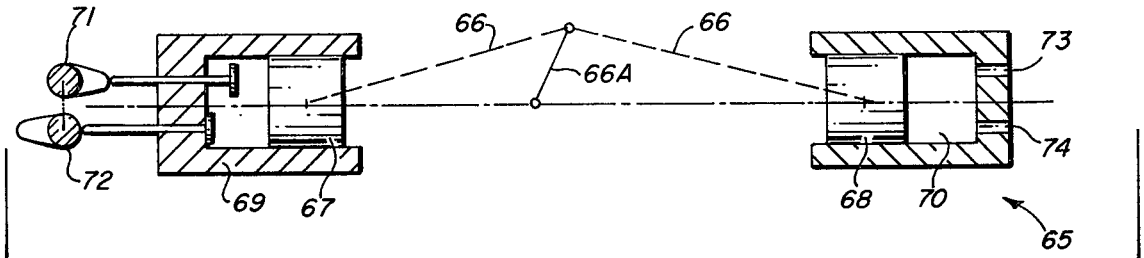
FIG. 7 is a diagrammatic illustration of combination compressor and expander motor interconnected by a crank.

FIG. 7 diagrammatically discloses a combination expander, compressor apparatus 65 wherein a pair of cam rods 66 and crank 66A interconnect pistons 67 and 68 which are mounted within housings 69 and 70, respectively. Housing 69 is provided with inlet and outlet ports controlled by cam actuated valves 71 and 72. Housing 70 is provided with inlet and outlet ports 73 and 74.

It should be noted that as crank 66A rotates relative movement of pistons 67 and 68 occurs. Although the piston diameters are shown as being of substantially the same diameter they can be modified with the diameter of the compressor piston 68 being up to 2.5 times the diameter of the piston 67 of the expander.

FIG. 8 diagrammatically illustrates a swash plate driven piston compressor, expander apparatus 75 employing one or more cylindrical housings 76 having mounted within each housing a multiple diameter piston 77 controlled by a swash plate assembly 78. The expander portion of the housing 76 is provided with the smaller diameter portion of the piston and with inlet and outlet ports 79 and 80 while the compressor portion of the housing is provided with the larger diameter portion of the piston and inlet and outlet ports 81 and 82, respectively.

Although only two symetrically positioned housing and piston assemblies are shown in FIG. 8, an odd or even number of compressor and expander assemblies such as the numbered portions of FIG. 8 may be utilized.

Thus, a new system employing a high expansion ratio motor in place of an expansion value is disclosed in addition to hardware configurations of various usable high expansion ratio motors with such motor being in a common housing with suitable compressor structures.

It should be noted that this invention teaches the use of an expansion motor in a refrigeration system of the type that produces thermodynamic equilibrium with positive closed or contained expansion of the fluid used in the system. This system approaches total utilization of the energy available in the system while the maximum efficiency of the known turbine motors is approximately 66 percent.

Although but a few embodiments of the invention have been illustrated and described, it will be apparent to those skilled in the art that various changes and modifications may be made therein without departing from the spirit of the invention or from the scope of the appended claims.

What is claimed is:

1. A method of improving the efficiency of a vapor compression refrigeration system including a compressor, condenser, high expansion ratio, large displacement, closed expansion motor and evaporator connected in a series arrangement and a prime mover drivingly connected to said compressor comprising the steps of:

operating said compressor to pass a saturated vapor refrigerant from its low side to its high side wherein the refrigerant undergoes isenthalpic compression, passing said high pressure vapor refrigerant from said compressor to said condenser wherein heat is rejected from the vapor condensed into a liquid at a constant pressure, passing said liquid from said condenser in a saturated condition to said high expansion ratio, large displacement motor for expansion in a closed housing to a lower pressure liquid vapor mixture causing said motor to provide relative movement of its component parts, directly coupling the relative movement of the component parts of said motor to said compressor for actuation thereof, passing said lower pressure liquid vapor mixture to said expander for a heat absorbing function, and passing the lower pressure liquid from said evaporator back to the lower pressure side of said compressor.

2. A vapor compression refrigeration apparatus comprising:

a housing, fluid actuated means movably mounted in said housing, said housing defining between the inside periphery thereof and said fluid actuating means two spacedly positioned chambers, one comprising an expansion chamber and the other a compression chamber, a condenser, an evaporator, a prime mover for operating said fluid actuating means to cause compression of a vapor refrigerant in said compression chamber, means for transmitting the compressed vapor in said compression chamber which has undergone isenthalpic compression in said compression chamber to said condenser, said condenser receiving the high pressure vapor refrigerant from said compression chamber and condensing it into a liquid while rejecting heat therefrom, means for transmitting said liquid from said condenser to said expansion chamber for expansion to a lower liquid vapor pressure, said liquid during expansion to the lower pressure liquid vapor expanding against said fluid actuating means in a direction to aid said prime mover in moving said fluid actuating means, means for transmitting said lower pressure liquid vapor to said expander for a heat absorbtion function, and means for transmitting said lower pressure liquid vapor from said expander to said compression chamber.

3. The vapor compression refrigeration apparatus set forth in claim 2 wherein:

said fluid actuating means comprises a rotor, said housing and said rotor being movable one relative to the other.

4. The vapor compression refrigeration apparatus set forth in claim 2 wherein:

said fluid actuating means comprises a piston reciprocally mounted in said housing.

* * * * *